US006575461B1

(12) United States Patent
Rider

(10) Patent No.: US 6,575,461 B1
(45) Date of Patent: Jun. 10, 2003

(54) SINGLE/DOUBLE SHEET STACKER

(75) Inventor: Jason P. Rider, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 47 days.

(21) Appl. No.: 10/002,125

(22) Filed: Dec. 5, 2001

(51) Int. Cl.[7] ..... B65H 29/06

(52) U.S. Cl. ..... 271/315; 271/187; 271/9.12; 270/52.09

(58) Field of Search ..... 271/187, 315, 271/83, 9.01, 9.12; 270/52.09; 83/934

(56) References Cited

U.S. PATENT DOCUMENTS

| | | | | | |
|---|---|---|---|---|---|
| 4,385,756 | A | | 5/1983 | Beery | 271/186 |
| 5,058,880 | A | | 10/1991 | McGraw et al. | 271/315 |
| 5,065,996 | A | | 11/1991 | McGraw et al. | 271/176 |
| 5,114,135 | A | | 5/1992 | Evangelista et al. | 271/187 |
| 5,377,965 | A | | 1/1995 | Mandel et al. | 270/37 |
| 5,409,202 | A | | 4/1995 | Naramore | 270/53 |
| 5,476,256 | A | | 12/1995 | Fortuna et al. | 271/187 |
| 5,540,370 | A | * | 7/1996 | Ring | 225/100 |
| 5,551,681 | A | | 9/1996 | Ferrara | 270/58.08 |
| 5,570,172 | A | | 10/1996 | Acquavia | 355/323 |
| 5,620,177 | A | * | 4/1997 | Takemoto et al. | 271/176 |
| 5,642,876 | A | | 7/1997 | Ferrara | 270/58.01 |
| 5,692,740 | A | | 12/1997 | Holtje | 270/58.01 |
| 5,696,690 | A | | 12/1997 | Richardson et al. | 364/478.07 |
| 5,765,824 | A | | 6/1998 | Kawano et al. | 270/58.11 |
| 5,842,695 | A | | 12/1998 | McVeigh | 271/187 |
| 6,131,900 | A | | 10/2000 | Hou | 271/184 |
| 6,152,445 | A | * | 11/2000 | Hirota et al. | 271/315 |
| 6,199,860 | B1 | * | 3/2001 | d'Agrella et al. | 271/315 |
| 6,341,773 | B1 | * | 1/2002 | Aprato et al. | 271/9.13 |
| 6,394,450 | B2 | * | 5/2002 | Kishine et al. | 271/315 |
| 6,460,842 | B1 | * | 10/2002 | Koelle | 270/58.01 |
| 6,467,763 | B1 | * | 10/2002 | Depoi et al. | 270/52.09 |

* cited by examiner

*Primary Examiner*—Patrick H. Mackey
(74) *Attorney, Agent, or Firm*—Joseph M. Young

(57) ABSTRACT

A sheet-stacking apparatus capable of receiving two sheets at substantially the same time, which includes a disk unit including four substantially identical rotatable disks, each disk including a receiving slot for receiving a portion of a sheet therein. The disk unit is arranged so that two of the four disks receive portions of a first sheet and the remaining two disks receive portions of a second sheet. Embodiments also include a bin into which the first sheet and the second sheet are deposited and a selectively extendable separator that separates the first sheet and the second sheet into two separate stacks. The apparatus can also include a tamping mechanism.

20 Claims, 5 Drawing Sheets

FIG. 5
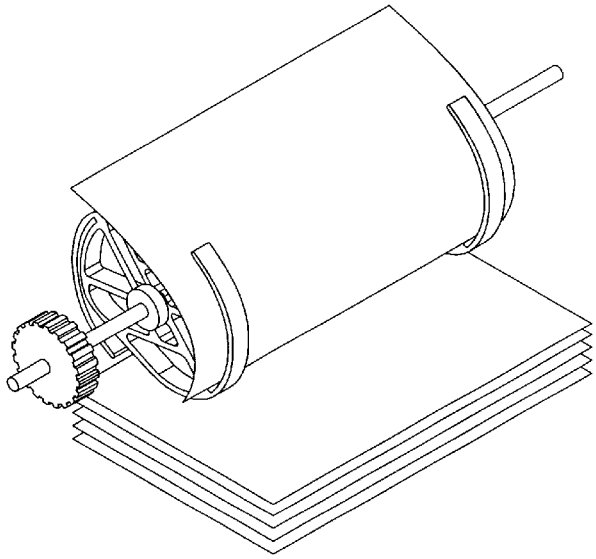
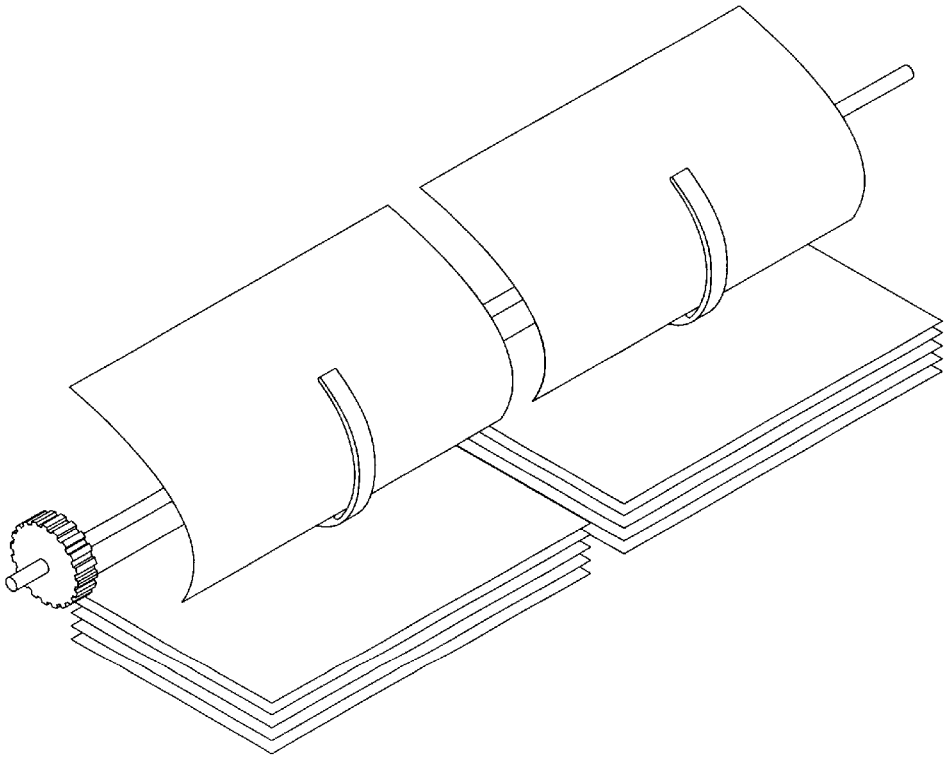
FIG. 6

FIG. 7
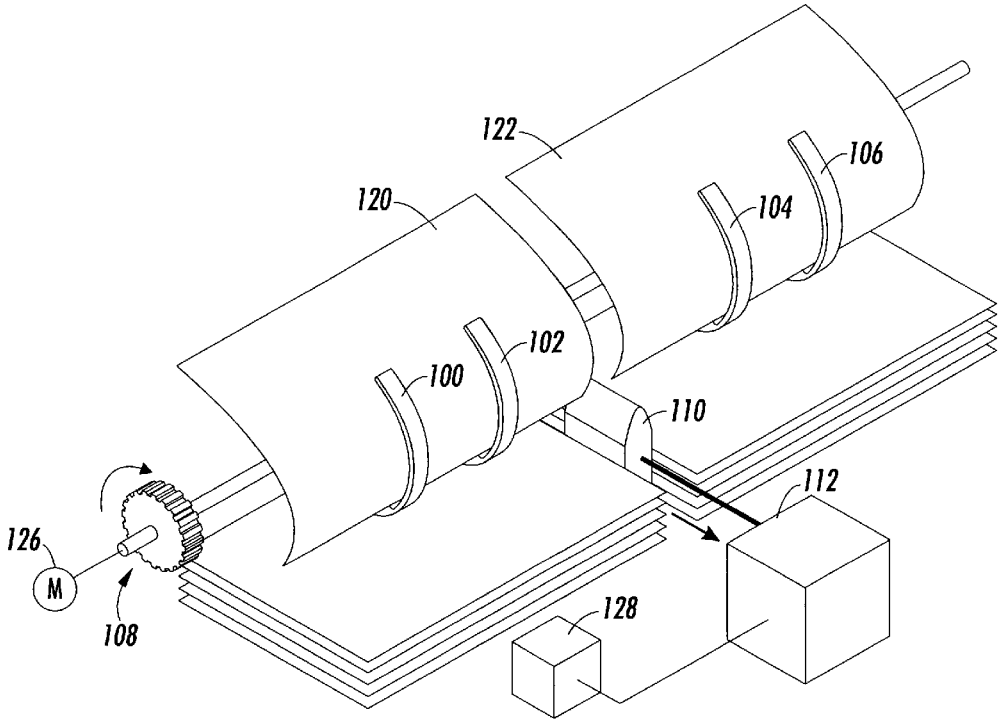
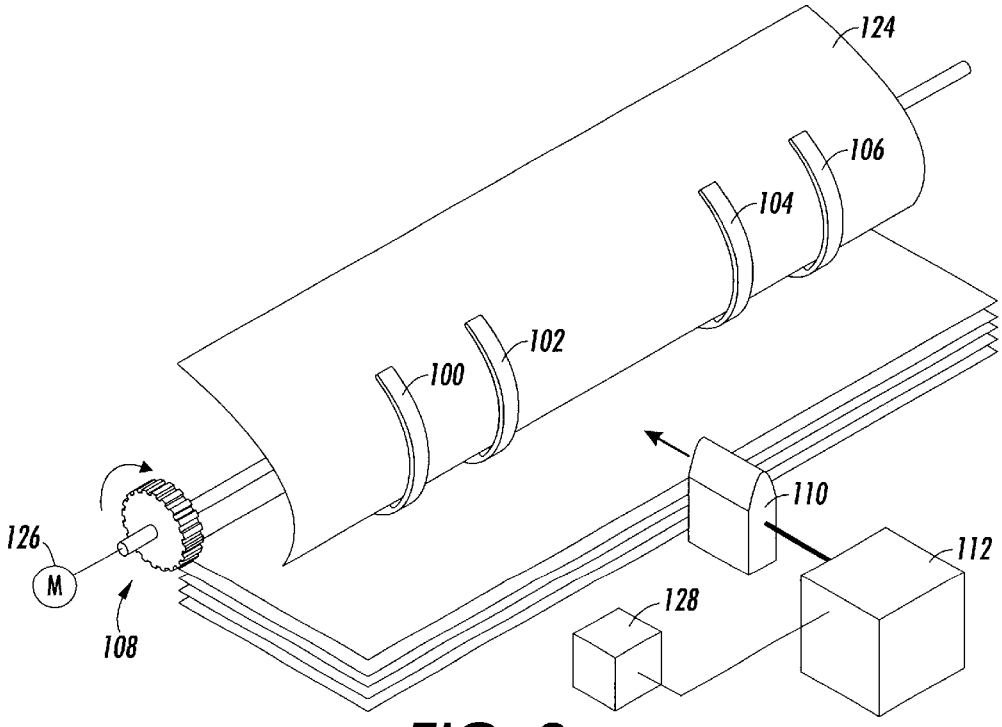
FIG. 8

SINGLE/DOUBLE SHEET STACKER

BACKGROUND AND SUMMARY

This invention relates to high speed printers and more specifically, it relates to a stacker that can handle both a single sheet and multiple sheets as they come up.

In many automatic copying or printing machines, rotating disk stackers are often used for providing combined sheet inversion and stacking of output copy sheets. In a typical rotating disk stacker, copy sheets are sequentially transported into an arcuate receiving slot on a rotating disk. The copy sheet lead edge is inserted into the receiving slot and the copy sheet is temporarily maintained in contact with the rotating disk such that the rotating movement of the disk flips the sheet over and simultaneously guides the inverted sheet into a collecting tray. Inverted sheet stacking devices of this type, sometimes referred to as "windsor stackers", are well known and have been disclosed, for example, in commonly assigned U.S. Pat. Nos. 4,385,756, 5,058,880, 5,065,996, 5,114,135, 5,409,202, 5,476,256, and 5,551,681 among others. The disclosures of these patents are hereby incorporated by reference in their entirety.

Customer requirements for printer output speeds are constantly increasing. One way to increase the speed of the printer, without increasing the speed of the xerographic module, is to print two-up. Printing two-up involves printing two images side-by-side on the same large sheet (11"×17" for example). Then, after the sheet is printed, it is fed into a slitter module, which slits the sheet into two smaller sheets (8.5"×11"). Two sheets arrive "two-up" at the next device. This effectively doubles the output speed of the printer.

Since most printers embody digital technology, the images on each side of the sheet can either be duplicates or prints from separate jobs. However, printing two-up creates problems after the slitting has occurred because now there are two sheets traveling side-by-side through the paper path. Current stackers have difficulty handling two sheets at once.

At least two methods have been used to stack sheets that are printed two-up. In some machines, the paper paths of the sheets are merged so that one of the sheets is moved such that it is on top of the other. This method is shown schematically in FIG. 1. In other machines, the sheets are sequenced by changing the direction of travel of the sheets by 90°. This method is shown schematically in FIG. 2. The sheets arrive at the sequencer in parallel, but continue in a sequential order. Both of these options require an expensive module for preparing the sheets to be stacked.

Disclosed embodiments include a sheet-stacking apparatus, which includes four substantially identical similar, rotatable disks; wherein each disk includes a receiving slot for receiving a portion of a sheet therein; a disk rotation system that rotates the four disks; a selectively extendable separator; and an actuator for selectively extending the separator when at least two sheets enters the stacker at substantially the same time and retracting the separator when a single sheet enters the stacker.

Embodiments include a shaft connected to each of the four disks and about which each of the four disks rotates and a stepper motor operably connected to the shaft for rotating the shaft.

Embodiments also include a controller operably connected to the actuator, wherein the controller causes the actuator to extend or retract the separator.

Embodiments also include a method for stacking sheets arriving in a two-up manner, which includes rotating a first sheet of paper with a first pair of disks until the first sheet is inverted; rotating a second sheet of paper with a second pair of disks until the second sheet is inverted, wherein the first sheet and the second sheet are rotated substantially simultaneously; and separating the first sheet from the second sheet with a selectively extendable separator.

Embodiments also include a stacking apparatus, which includes first, second, third, and fourth substantially similar disks, each disk having a substantially common axis of rotation with the others, wherein each disk includes a receiving slot for receiving a portion of a sheet therein, and wherein said first, second, third, and fourth disks are coaxial; a disk rotation system that rotates said first, second, third, and fourth disks; a selectively extendable separator; and an actuator for selectively retracting the separator when at least one sheet having a first width enters the stacker and extending the separator when at least one sheet having a second width enters the stacker.

In embodiments, the first, second, third, and fourth disks are symmetrically arranged into two pairs of disks, with said first and second disks on one side of the separator and said third and fourth disks on another side of the separator when the separator is extended.

In embodiments, the second width is approximately half the first width.

BRIEF DESCRIPTION OF THE DRAWINGS

Embodiments will be described in detail herein with reference to the following figures in which like reference numerals denote like elements and wherein:

FIG. 5 is a schematic representation of a single large sheet being inverted by a single pair of stacking disks;

FIG. 6 is a schematic representation of two sheets being inverted by a single pair of stacking disks;

FIG. 7 is a schematic representation of a stacking unit having four stacking disks simultaneously stacking a pair of sheets;

FIG. 8 is a schematic representation of a stacking unit having four stacking disks simultaneously stacking one sheet.

DETAILED DESCRIPTION OF EMBODIMENTS

Figure 1:
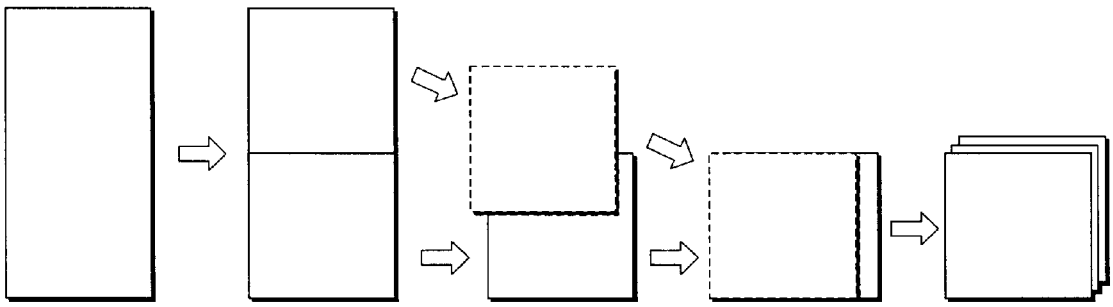
FIG. 1 is a schematic view of a prior art pre-stacking sheet merging method.
Figure 2:
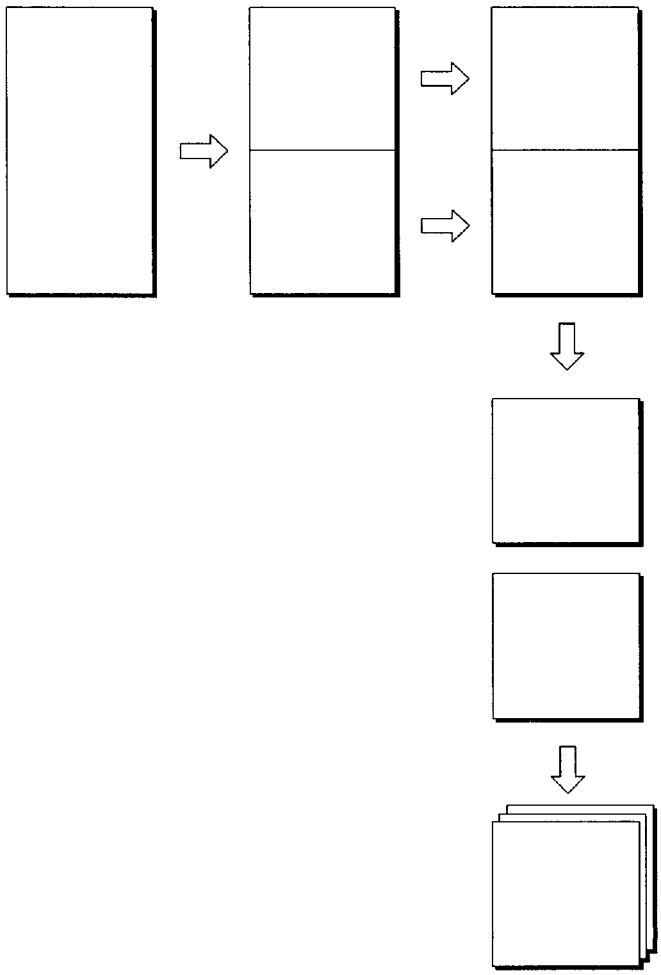
FIG. 2 is a schematic view of a prior art pre-stacking sheet sequencing method.

While the present invention will be described with reference to specific embodiments thereof, it will be understood that the invention is not to be limited to these embodiments. On the contrary, it is intended that the present invention cover all alternatives, modifications, and equivalents as may be included within the spirit and scope of the invention as defined by the appended claims. Other aspects and features of the present invention will become apparent as the description proceeds, wherein like reference numerals have been used throughout to designate identical elements. It is further noted that all references cited anywhere in this specification, and their references, are hereby incorporated by reference where appropriate for relevant teachings of additional or alternative details, features, and/or technical background.

Figure 3:
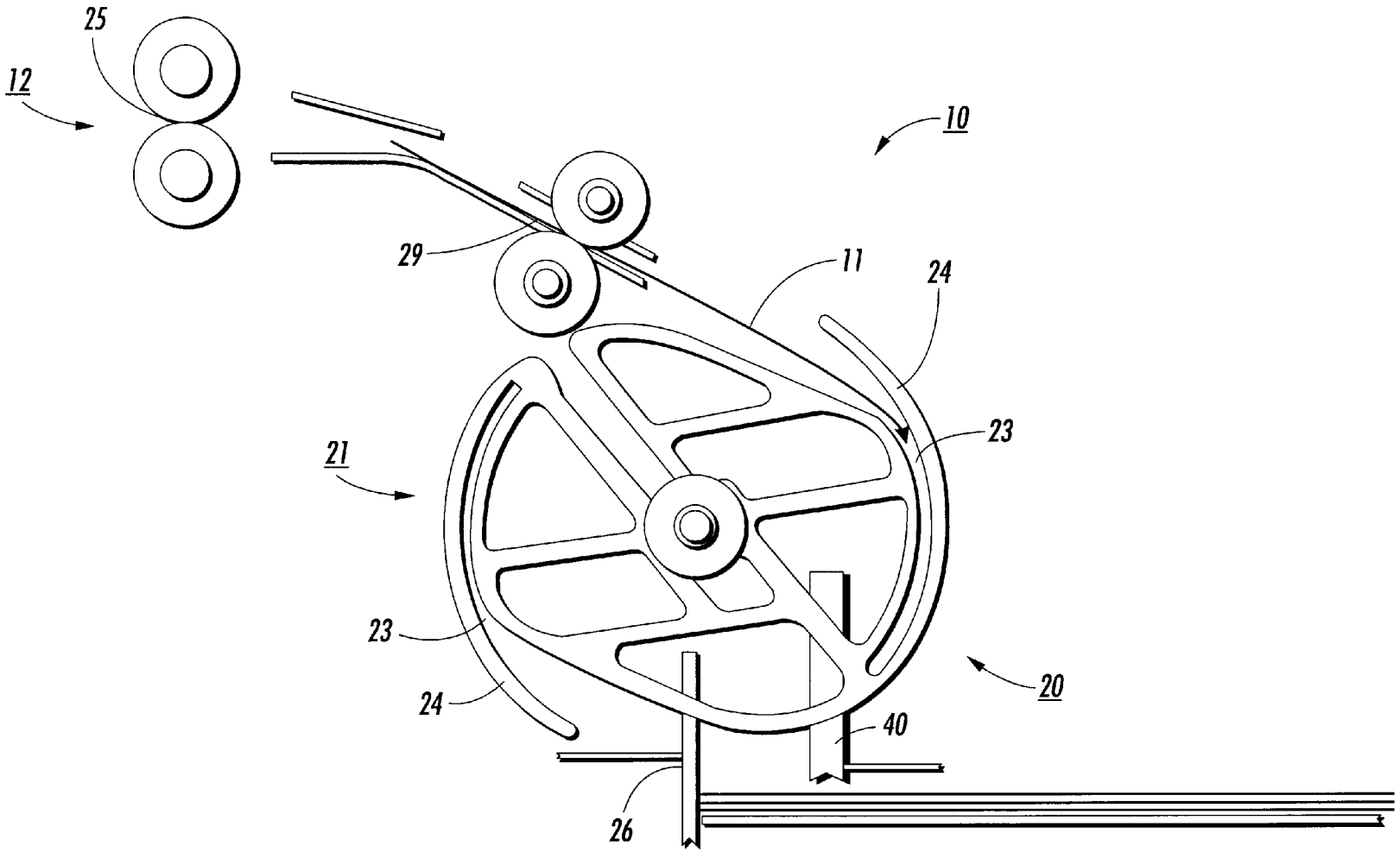
FIG. 3 is a schematic side view of one embodiment of a general disk stacking system, showing a copy sheet entering a rotating disk.
Figure 4:
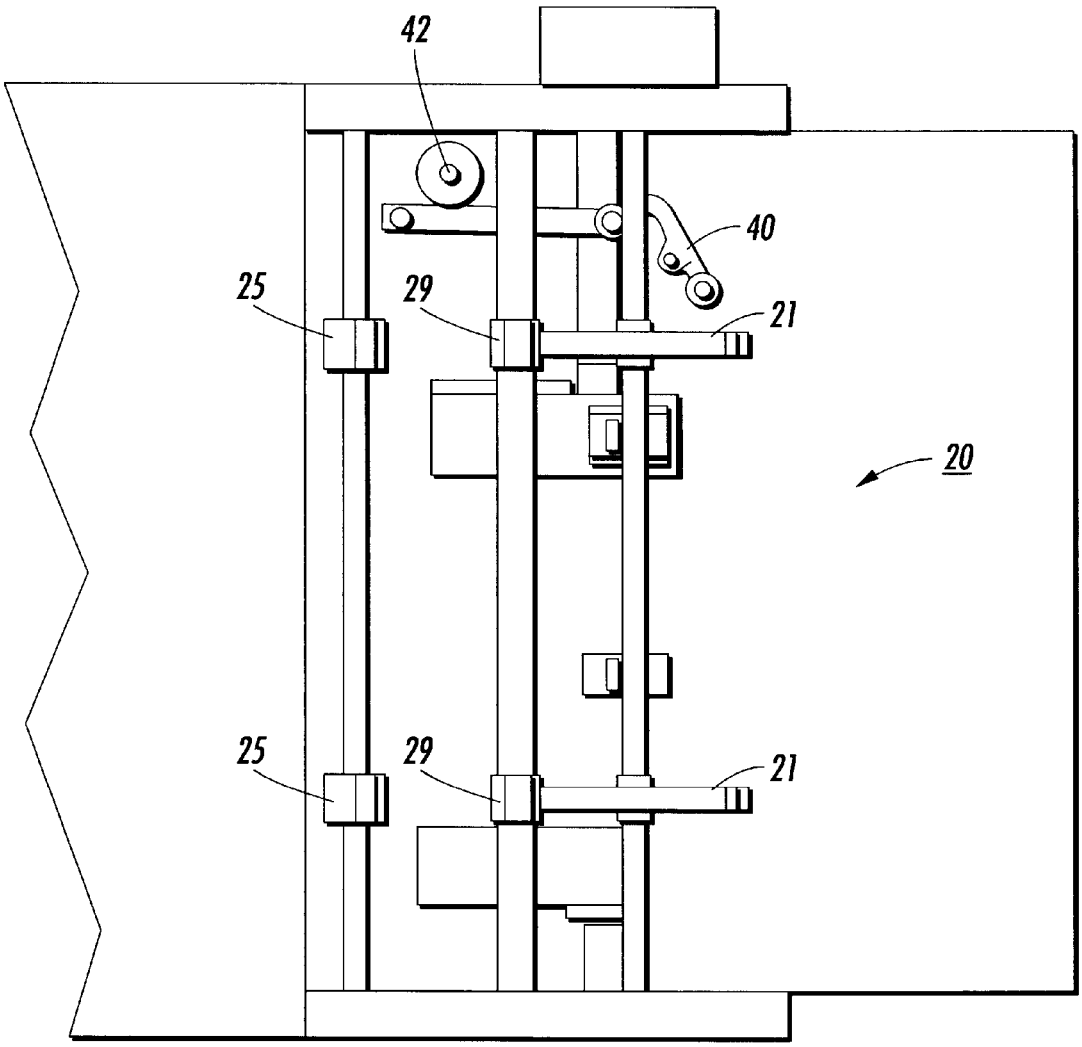
FIG. 4 is a schematic top view of the stacking system of FIG. 3.

For a general understanding of the copy sheet output section of an electrostatographic printing machine and, in particular, a typical disk stacker of the type in which the features of the present invention may be incorporated, reference is initially made to FIGS. 3 and 4. Although the apparatus of the present invention is particularly well adapted for use in electrostatographic reproducing machines such as the one shown in FIGS. 3 and 4 and discussed in more detail below, it will become apparent from the following discussion that the disk stacking apparatus disclosed herein is equally well suited for use in a wide variety of copy or print machines as well as in any other system using a rotating disk-type sheet delivery apparatus.

FIGS. 3 and 4 illustrate the basic components of an exemplary copy sheet output section comprising a copy sheet transport and delivery module 10 which typically receives output copy sheets 11 through a feeder section 12 via feed rollers 25. This feeder section 12 can represent a conventional high-speed copier or printer. The copy sheet transport and delivery module 10 includes a disk stacker section comprising a rotating disk unit 20 having one or more disks 21. Each disk 21 has one or more arcuate fingers 24 located along its periphery defining arcuate receiving slots 23 for receiving output copy sheets 11 therein.

By way of description of the operation of a typical disk stacker, a copy sheet 11 exits an upstream device, such as a printer or copier through output rollers (not shown), entering the disk stacker module 10 through feeder section 12 where the sheet is engaged by one or more pairs of disk stacker input rollers 25. The copy sheet 11 is then transported into contact with input rollers 29, which drive the sheet into receiving slot 23 of disk 21. After a sheet is fed into a receiving slot 23, the disk 21 rotates to invert and transport the sheet until the leading edge of the sheet is positioned against a fixed registration wall 26. The registration wall 26 strips the sheet from the rotatable disk 21 as the disk continues to rotate through openings in the fixed wall 26, thereby allowing the sheet to drop onto the top of a stack of previously inverted sheets, as shown. Various conventional devices known in the art, such as a stepper motor or a cam drive mechanism can control the rotational movement of disk unit 20. Preferably, a sensor is located upstream of disk unit 20 for detecting the presence of a sheet approaching the disk unit 20. The disk input rollers 29 operate at a constant velocity such that the time required for the sheet 11 lead edge to reach the disk slot after detection by the sheet sensor can be easily determined. Thereafter, as the lead edge of the sheet 11 begins to enter the slot 23, the disk rotates through a 180° cycle.

The foregoing description generally described features of a disk stacking unit. The features described should not be considered as limitations of the embodiments described herein.

Current stackers typically have two disks placed so that any single sheet that enters is under control at two points. See FIG. 5. Having two points of control lessens the chance that a sheet will fall out of a disk while it is being stacked and increases the uniformity of a stack, i.e., the sheets in the stack are more aligned.

However, in some printing systems sheets may exit two at a time as well as one at a time. For example, a printer may be alternately capable of outputting single large (e.g., 11"× 17") sheets or two smaller sheets (8.5"×11"). The latter is known as "two-up" printing. Printing two-up involves printing two images side-by-side on the same large sheet (such as the 11"×17" sheet of the previous example). Then, after the sheet is printed, it is fed into a slitter module (not shown), which slits the sheet into two smaller sheets (8.5"×11"). This method effectively doubles the output speed of the printer.

In the case where one large sheet is produced, the two disks shown in FIG. 5 should have no problem guiding the sheet into a bin or other sheet receiving container. However, when two sheets enter the stacker simultaneously (see FIG. 6) and each sheet is only under the control of a single disk, the sheets will often either fall out of the disk or move while being transported by the disk. Either occurrence will create a poor quality stack.

Embodiments of a novel sheet-stacking apparatus include a disk unit having four substantially identical rotatable disks 100, 102, 104, 106 forming four separate nips, as seen, for example, in FIG. 7. The four disks are all connected to a shaft 108. The shaft 108 is in turn rotated by a disk rotation device operably connected to the shaft. The disk rotation device can be a stepper motor 126 as shown in FIGS. 7 and 8. While a stepper motor has been used for purposes of the present invention, other disk rotation devices will be known to those skilled in the art.

The use of four disks 100, 102, 104, 106 in a disk stacking unit allows each of a pair of "two-up" sheets (120, 122) to be inverted by two disks at once, and thus be under complete control while the disks are in motion. Two sheets arrive at a finishing device two-up when they have substantially the same dimensions and they arrive at a device at substantially the same time.

Because all four disks are mounted on the same shaft 108 and controlled by the same stepper motor 126, misalignment of the disks is not probable. Additionally, this stacking mechanism can still be used to stack larger sheets 124 (as is shown in FIG. 8) just as easily as before, only now the large sheets arriving one-up are under the control of all four disks at once.

In embodiments, the disks can also be positioned so that each pair of disks transporting a sheet are substantially symmetrically located about the center of each of the incoming edges of each sheet. This embodiment is shown in FIG. 7. To help ensure that each of the resulting slit sheets is of equal size, the single large sheets are center registered. After being separated, the two-up sheets tend to be centered about a line normal to the leading edge of the sheets and located midway between them. Therefore, the disks have been positioned so that they will symmetrically rotate both a single large sheet arriving one-up and each of a pair of small sheets arriving two-up. However, it should be noted that the embodiments described herein are not limited to symmetrically arranged disks.

In cases where two separate stacks will be created, side-by-side the stacks will be in close proximity to each other, and if there is no internal divider between the two stacks, it is still possible that a sheet will end up misaligned and create poor quality stacks.

To combat this problem, embodiments also contain a retractable separator 110 that is used to keep the sheets in one stack of the dual stack configuration from dropping onto the other stack after it leaves control of the disk, or prevent the sheets from hitting each other while being dropped. The separator 110 is located so that the disks 100, 102, 104, 106 are separated into two separate pairs (100, 102) and (104, 106) when the separator 110 is engaged. This separator 110 will serve to both guide each of the sheets (120, 122) into its proper stack location as well as serve as a wall to register against so that each of the sheets will end up in the same location. This separator 110 should be retractable to allow larger sheets to be stacked without interference from the separator. To that end, embodiments can include an actuating mechanism 112 operably connected to the separator 110 to extend and retract the separator 110. The actuating mechanism is in turn connected to a controller 128, which sends a signal to the actuating mechanism to extend the separator 110 when two sheets enter the stacking apparatus.

The actuating mechanism 112 may be one of many types known in the art including, but not limited to, a simple mechanical lever, or electromechanical devices that use solenoids or cam systems.

The controller 128 can be any of a variety of controlling mechanisms. It can be, for example, a electrical or mechanical switch, which the user simply opens or closes by pressing a button or moving a lever at a control panel. It can also be, for example, a logic circuit connected to a sensor. For example, the sensor can detect two sheets coming in two-up, the width of an incoming sheet, or possibly some third variable. The sensor would send a signal conveying this information to the controller, which in turn would send a signal to the actuator to extend or retract the separator depending on what signal the controller received from the sensor. The controller 128 can be part of the stacking apparatus or part of a printer or copying machine. The controller may even be the CPU of a computer connected to the printer. The nature of the controller should not be considered limiting.

In addition to the retractable separator, embodiments of the disk stacker unit 20 can also include a tamping mechanism or "tamper." Lateral tamping mechanisms, such as side or rear tamping mechanisms, can be used to assure that the sheets are straight and consistently placed on the stack.

An example of a tamping mechanism 40 is shown in FIGS. 3 and 4. This particular tamping mechanism 40 tamps each incoming sheet sideways (laterally) into its proper stack, without tamping the stack edge so as not to interfere with plural sets offsetting. All incoming sheets are so tamped one at a time. The illustrated lateral tamper system 40 for the incoming sheet is shown here as being driven by a cam 42 via pivotal lever arms from the sheet input drive system. Although it could also be operated by a solenoid, and spring loaded in the outboard or non-tamping position, preferably the tamper 40 motion is ramped to have a controlled acceleration movement by cam 42 or the like in order to control sheet inertia better. The shape of the tamper 40 drive cam 42 system can provide better control of sheet inertia. For variable sheet length end tamping, a multi-position tamper with a programmable stepper motor can be used.

The preceding description was meant to illustrate an example of a lateral tamping mechanism. However, many other tamping mechanisms may be used with the invention.

While the present invention has been described in terms of particular embodiments, it will be understood that it is not intended to limit the invention to these embodiments. On the contrary, it is intended to cover all alternatives, modifications, and equivalents as may be included within the spirit and scope of the invention as defined by the appended claims.

What is claimed:

1. A stacking apparatus, comprising:

four substantially similar, rotatable disks having a common axis, wherein each disk includes a receiving slot for receiving a portion of a sheet therein;

a disk rotation system that rotates the four disks;

a selectively extendable separator; and an actuator for selectively extending the separator when at least two sheets enters the stacker at substantially the same time and retracting the separator when a single sheet enters the stacker.

2. The apparatus of claim 1 further comprising a shaft connected to each of the four disks and about which each of the four disks rotates.

3. The apparatus of claim 2 wherein the disk rotation system includes a stepper motor operably connected to the shaft.

4. The apparatus of claim 1 further comprising a controller operably connected to the actuator, wherein the controller causes the actuator to extend or retract the separator.

5. The apparatus of claim 1 further comprising a tamping mechanism.

6. The apparatus of claim 1, wherein the four disks are arranged into two pairs of disks, with a first pair on one side of the separator and a second pair on another side of the separator when the separator is extended.

7. The apparatus of claim 6 wherein said first pair and said second pair of disks are symmetrically located about a line perpendicular to the common axis.

8. A method for stacking sheets arriving in a two-up manner comprising:

rotating a first sheet of paper with a first pair of disks until the first sheet is inverted;

rotating a second sheet of paper with a second pair of disks until the second sheet is inverted, wherein the first sheet and the second sheet are rotated substantially simultaneously;

separating the first sheet from the second sheet with a selectively extendable separator.

9. The method of claim 8, wherein the first pair of disks and the second pair of disks are coaxial.

10. The method of claim 8, wherein the first sheet and the second sheet are substantially the same size.

11. The method of claim 8 further comprising allowing the first sheet to drop onto a first stack and the second sheet to drop onto a second stack at substantially the same time.

12. The method of claim 11 further comprising tamping the first sheet into the first stack and tamping the second sheet into the second stack.

13. A stacking apparatus, comprising:

first, second, third, and fourth substantially similar, rotatable disks, each disk having a substantially common axis of rotation with the others, wherein each disk includes a receiving slot for receiving a portion of a sheet therein, and wherein said first, second, third, and fourth disks are coaxial;

a disk rotation system that rotates said first, second, third, and fourth disks;

a selectively extendable separator; and an actuator for selectively retracting the separator when at least one sheet having a first width enters the stacker and extending the separator when at least one sheet having a second width enters the stacker.

14. The apparatus of claim 13 further comprising a shaft connected to said first, second, third, and fourth disks and about which said first, second, third, and fourth disks rotate.

15. The apparatus of claim 14 wherein the disk rotation system comprises a stepper motor operably connected to the shaft, the stepper motor rotating the shaft thereby rotating the first, second, third, and fourth disks.

16. The apparatus of claim 13, wherein the first, second, third, and fourth disks are arranged into two pairs of disks, with said first and second disks on one side of the separator and said third and fourth disks on another side of the separator when the separator is extended.

17. The apparatus of claim 13 wherein the four disks are symmetrically located about a line perpendicular to the common axis.

18. The stacking apparatus of claim 13, wherein the second width is approximately half the first width.

19. The apparatus of claim 13 further comprising a controller operably connected to the actuator, wherein the controller causes the actuator to extend or retract the separator.

20. The apparatus of claim 13 further comprising a tamping mechanism.

* * * * *